US012747925B2

(12) United States Patent
Paulson

(10) Patent No.: US 12,747,925 B2
(45) **Date of Patent: *Sep. 29, 2026**

(54) SPADE GRIP ATTACHMENT ASSEMBLY FOR A MINIGUN

(71) Applicant: CHD Holdings, LLC, Nashville, TN (US)

(72) Inventor: Kristopher Lee Paulson, Hendersonville, TN (US)

(73) Assignee: CHD Holdings, LLC, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/351,467

(22) Filed: Oct. 7, 2025

(65) Prior Publication Data

US 2026/0098695 A1 Apr. 9, 2026

Related U.S. Application Data

(63) Continuation of application No. 18/628,451, filed on Apr. 5, 2024, now Pat. No. 12,460,884, which is a continuation of application No. 17/991,342, filed on Nov. 21, 2022, now Pat. No. 11,982,505.

(60) Provisional application No. 63/282,462, filed on Nov. 23, 2021.

(51) Int. Cl.

| | |
|---|---|
| ***F41A 21/30*** | (2006.01) |
| ***F41A 9/36*** | (2006.01) |
| ***F41A 21/06*** | (2006.01) |
| ***F41A 21/48*** | (2006.01) |

(52) U.S. Cl.

CPC ..... *F41A 21/30* (2013.01); *F41A 9/36* (2013.01); *F41A 21/06* (2013.01); *F41A 21/48* (2013.01)

(58) Field of Classification Search

CPC .... F41A 9/35; F41A 9/36; F41A 11/00; F41A 11/04

USPC ..... 89/12

See application file for complete search history.

(56) References Cited

U.S. PATENT DOCUMENTS

| | | | | |
|---|---|---|---|---|
| 9,664,478 | B2 | 5/2017 | Robinson | |
| 11,604,042 | B1 | 3/2023 | Paulson | |
| 11,754,355 | B2 | 9/2023 | Paulson | |
| 11,982,505 | B2 | 5/2024 | Paulson | |
| 12,460,884 | B2 * | 11/2025 | Paulson | F41A 9/36 |
| 2005/0215092 | A1 | 9/2005 | Schoppman | |
| 2013/0212920 | A1 | 8/2013 | Law | |
| 2016/0146563 | A1 * | 5/2016 | Garvis | F41A 9/29 434/16 |
| 2016/0305740 | A1 * | 10/2016 | O'Donnell | F41F 1/10 |
| 2022/0003515 | A1 * | 1/2022 | Alvarez | F41A 19/67 |

* cited by examiner

*Primary Examiner* — Bret Hayes

(74) *Attorney, Agent, or Firm* — Eric B. Fugett; Mark A. Pitchford; Pitchford Fugett, PLLC

(57) ABSTRACT

A spade grip attachment assembly for securing a spade grip to a minigun includes a first adapter member and a second adapter member. The first adapter member is on the spade grip. The second adapter member is on the minigun. The first and second adapter members are configured such that one is receivable in the other. Each adapter member can define a pair of coaxially aligned pin holes that align to form a passage in which a fastener is receivable when one adapter member is received in the other. The fastener is receivable in the passage to releasably secure the first adapter member to the second adapter member.

19 Claims, 10 Drawing Sheets

SPADE GRIP ATTACHMENT ASSEMBLY FOR A MINIGUN

CROSS-REFERENCES TO RELATED APPLICATIONS

This non-provisional patent application is a continuation of U.S. Non-Provisional patent application Ser. No. 18/628,451, filed Apr. 5, 2024 and titled "SPADE GRIP ATTACHMENT ASSEMBLY FOR A MINIGUN," which is a continuation of U.S. Non-Provisional patent application Ser. No. 17/991,342, filed Nov. 21, 2022 and titled "SPADE GRIP ATTACHMENT ASSEMBLY FOR A MINIGUN," which claims priority to U.S. Provisional Patent Application Ser. No. 63/282,462, filed Nov. 23, 2021 and titled "SPADE GRIP FOR MULTI BARREL WEAPON SYSTEMS," the entire disclosure of each of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM

Listing Appendix

Not Applicable.

BACKGROUND OF THE INVENTION

The present invention relates generally to the field of firearms, and more particularly, to rotary machine guns.

Rotary machine guns are used in various weapon platforms and military applications around the world. A rotary machine gun is an externally powered weapon system consisting of multiple barrels arranged to rotate about the central longitudinal axis of a rotor while discharging ammunition at a high rate of fire. An example is the M134 minigun, a six-barreled, electrically driven rotary machine gun with an external battery pack. A conventional M134 minigun 100 is depicted in prior art FIG. 1. The M134 minigun includes a rotor housing 102 containing a rotor 104. The central portion of the rotor 104 has six bolt tracks (not visible) for receiving and firing ammunition. The bolts tracks are arranged radially around the central axis 105 of the rotor 104. The central axis 105 is a longitudinal axis of the gun 100 about which the barrels 106 rotate. The barrels 106 are attached to a forward end of the rotor 104. Also at the forward end of the rotor 104 is a drive gear 108 driven by a motor gearhead 110 connected to a main drive motor 112 mounted on top of the rotor housing 102. Rotation of the drive gear 108 rotates the rotor 104, causing the gun bolts to move within the bolt tracks to fire ammunition.

At the rear end of the rotor 104 is the clutch gear 114. The clutch 114 is positioned to mate with the feeder de-linker assembly 116 via a solenoid 118. The clutch 114 is configured to selectively engage the rotor 104 and drive the feeder de-linker 116 while actuated such that the feeder de-linker 116 rotates with the rotor 104 while the clutch 114 is engaging the rotor 104 and the feeder de-linker 116. The feeder de-linker 116 delinks ammunition and feeds it into the bolt tracks of the rotor 104 while the feeder de-linker 116 is being rotated.

Aft of the clutch 114 is a spade grip 120. The spade grip 120 sits at the rear of the minigun 100 and provides a handle by which an operator can point and aim the weapon. The spade grip 120 also houses the gun control unit (GCU) 122 which allows the operator to control firing of the minigun 100. The GCU 122 is configured to actuate the clutch 114 while providing power to the drive motor 112 from an external battery pack. The spade grip 120 connects the GCU 122 and battery pack to the clutch 114 and rotor housing 102. The GCU 122 is secured to a top plate 121 of the spade grip 120 by two threaded bolts 124.

Another conventional spade grip 120, as exemplified in prior art FIGS. 2-5, is attached at its forward end 123 to the rear end of the minigun housing 102 using three bolts 126. That is, the spade grip 120 is bolted directly to the rear end of the rotor housing 102, aft of the clutch 114. The three bolts 126 are received in three corresponding threaded sockets 128 formed in wings 130 on the housing 102. The head of each bolt 126 is recessed into the rear surface of the forward plate 123 of the spade grip 120. An annular locating member 132 is connected to the rear of the clutch 114. The locating member 132 sits between the clutch 114 and the forward end 123 of the spade grip 120. A locating tab 134 protrudes forwardly from the body of the locating member 132 along the exterior of the rotor housing 102. The locating tab 134 is received between and engages two parallel protrusions 136 on the side of the housing 102. The locating member 132 and protruding locating tab 134 facilitate proper orientation and timing of the clutch 114 and prevent the clutch 114 from rotating during discharge of the minigun 100.

In some other conventional miniguns, the spade grip 120 is bolted to the clutch 114 via four threaded sockets 128 formed in the clutch 114 (see, for example, the pattern of sockets 128 depicted in FIG. 16). In such models, the locating member 132 is disposed between the front end 123 of the spade grip and the clutch 114. The locating tab 134 protrudes forward to rest between the two parallel protrusions 136 on the side of the housing 102 as described above.

Disassembly of conventional miniguns 100 requires removal of the bolts 124 securing the GCU 122 to the spade grip 120 and also the bolts 126 securing the spade grip 120 to the rotor housing 102 or clutch 114. To disconnect such a "legacy" style spade grip 120, the operator must use a wrench to first remove the GCU bolts 124 in the top of the spade grip 120, then remove the bolts 126 in the front plate 123 of the spade grip 120 that secure the spade to the clutch 114 or housing 102. This allows removal of the spade grip 120 so that the operator can access the clutch 114, which is covered by the spade grip 120 when assembled. After fully disassembling these components, the operator may remove any additional bolts from the clutch 114 and continue disassembling the remainder of the minigun 100. Such legacy spade grips 120 therefore require undesirably long disassembly times, which in turn dictate longer time for maintenance, transport, and assembly for deployment. Moreover, this can slow repairs when the minigun is in use in the field, thereby endangering the lives of the operator and any allied personnel the weapon was deployed to support.

What is needed are improvements in minigun spade grips and mechanisms for attaching a spade grip to a minigun.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Features of the presently disclosed invention overcome or minimize some or all of the identified deficiencies of the prior art, as will become evident to those of ordinary skill in the art after a study of the information presented in this document.

One aspect of the present invention provides an attachment assembly for securing a spade grip to a rotary machine gun having a plurality of barrels, such as the M134 minigun. The attachment assembly includes a first adapter member configured to be secured to the spade grip, and a second adapter member configured to be secured to the minigun. The adapter members are further configured such that one adapter member is slidably receivable in and releasably securable to the other adapter member. Put differently, one adapter member can be a male adapter member, and the other can be a female adapter member in which the male adapter member is receivable into mating engagement.

The two adapter members can be releasably secured to one another with a locking pin. As such, when one adapter member is secured to the spade grip and the other adapter member is secured to the minigun, the spade grip can be quickly and easily secured to or detached from the minigun by respectively inserting or withdrawing the locking pin through a plurality of coaxially aligned pin holes defined through the sides of the adapter members while the male adapter member is received in and matingly engaged with the female adapter member. This configuration can significantly hasten repairs and enable immediate substitution of one adapter-member equipped spade grip for another.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
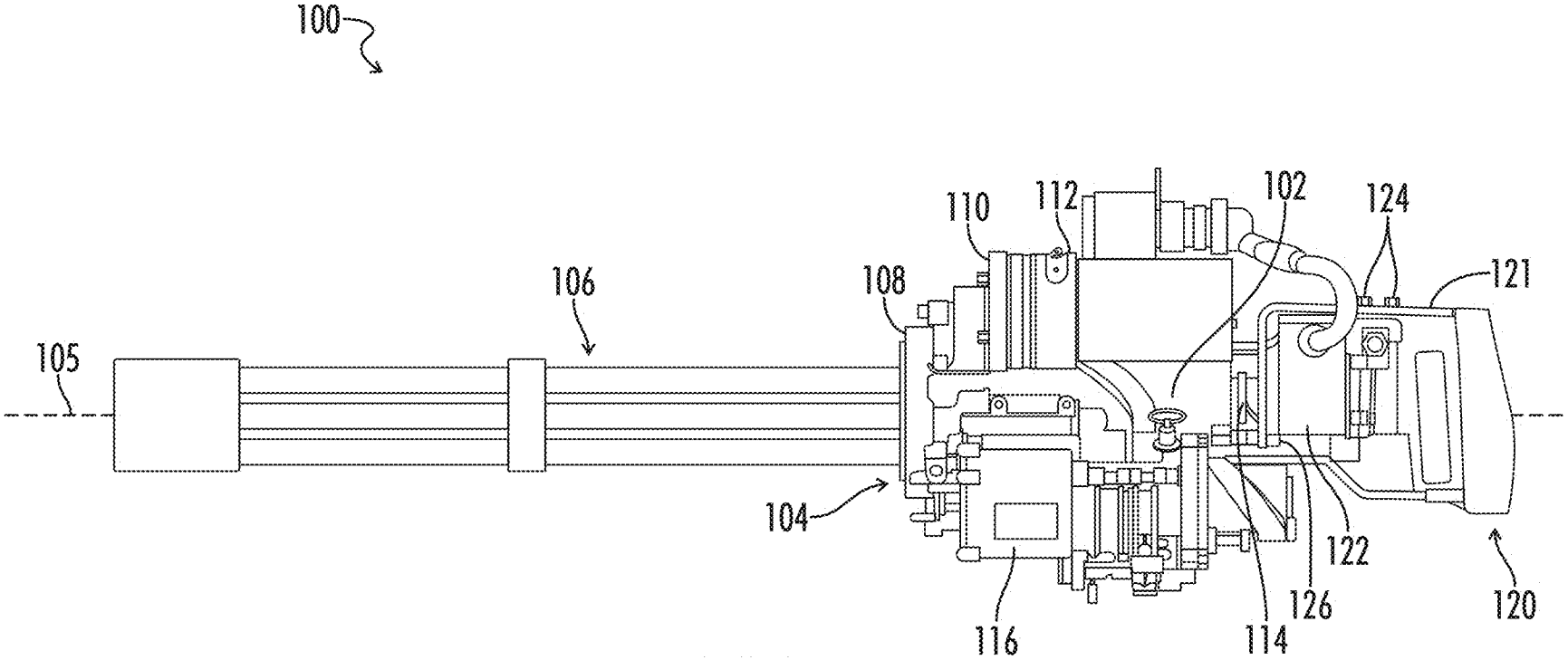
FIG. 1 (PRIOR ART)
FIG. 1 is a left side elevational view of a conventional M134 rotary machine gun (i.e., "minigun").
Figure 2:
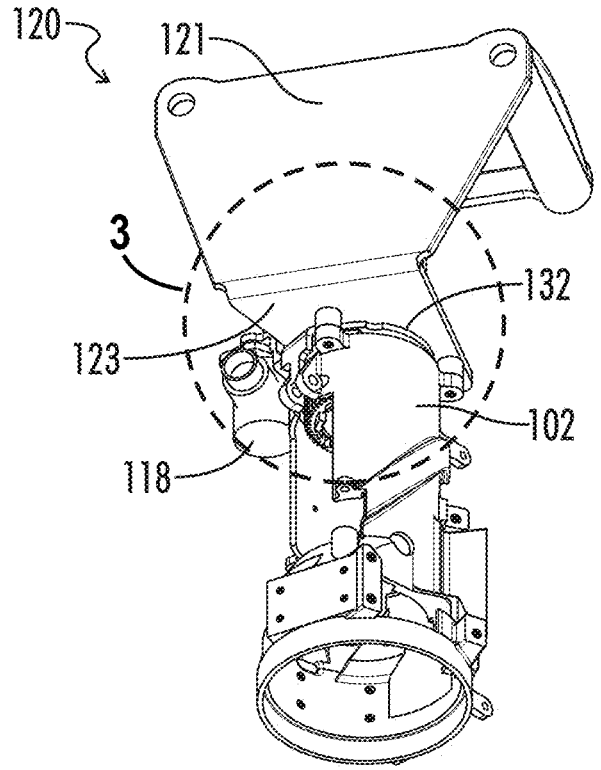
FIG. 2 (PRIOR ART)
FIG. 2 is an upper front left side perspective view of a conventional spade grip attached to a conventional minigun clutch and rotor housing. Various other parts of the minigun, including the rotor and GCU, are omitted for clarity.
Figure 3:
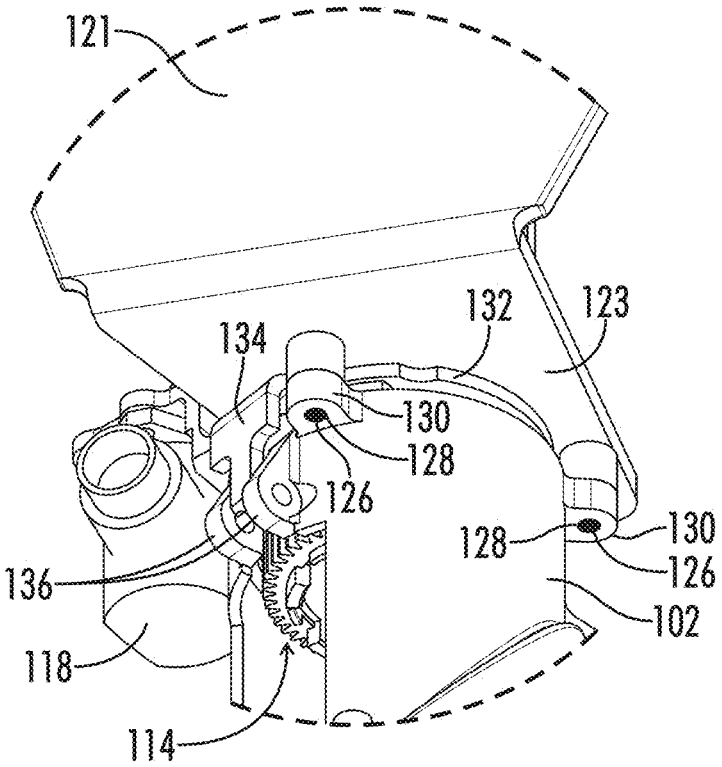
FIG. 3 (PRIOR ART)
FIG. 3 is an enlarged detail view of the objects of FIG. 2 at location 3.
Figure 4:
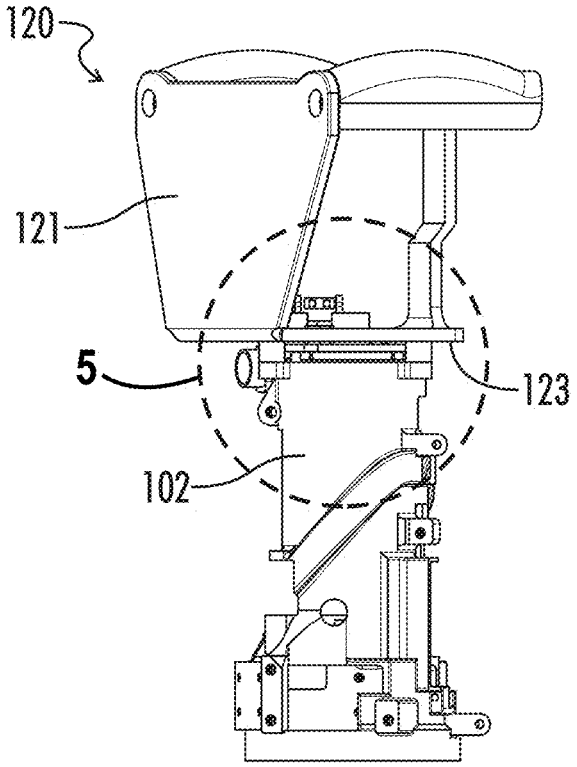
FIG. 4 (PRIOR ART)
FIG. 4 is an upper left side elevational view of the objects of FIG. 2.
Figure 5:
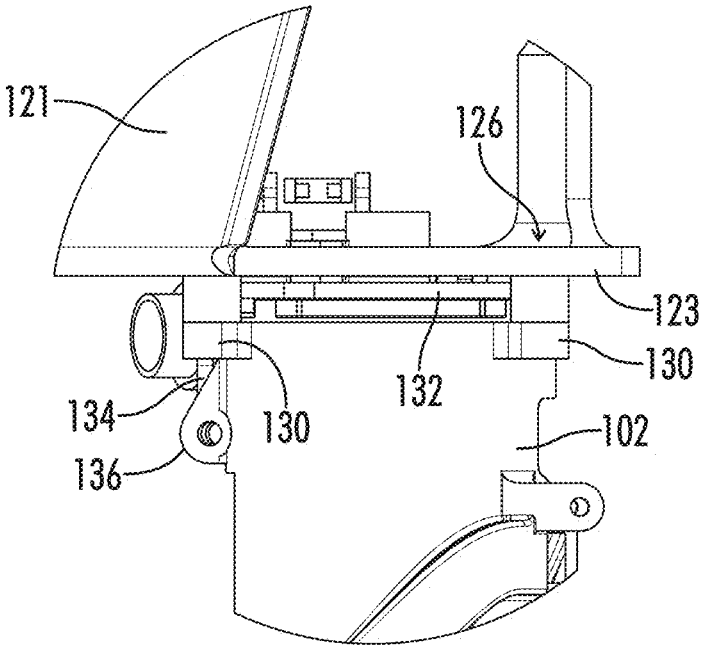
FIG. 5 (PRIOR ART)
FIG. 5 is an enlarged detail view of the objects of FIG. 4 at location 5.
Figure 6:
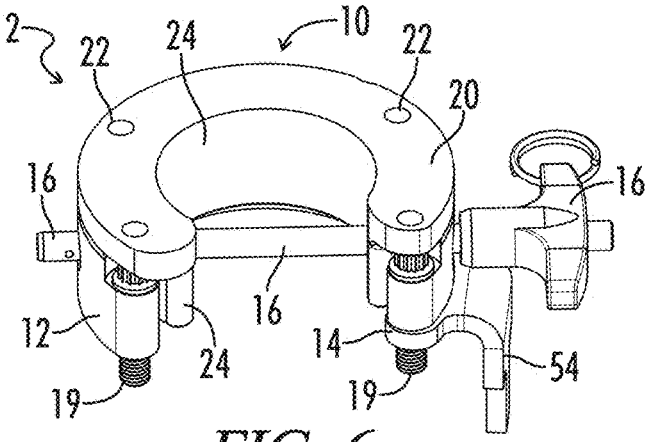
FIG. 6 is an elevated perspective view of the rear end of a novel spade grip attachment assembly for a minigun constructed in accordance with an embodiment of the invention.
Figure 7:
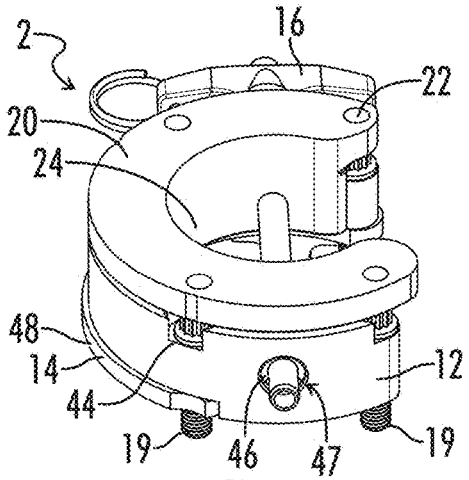
FIG. 7 is another elevated perspective view of the objects of FIG. 6 showing the objects rotated approximately 90 degrees counterclockwise.
Figure 8:
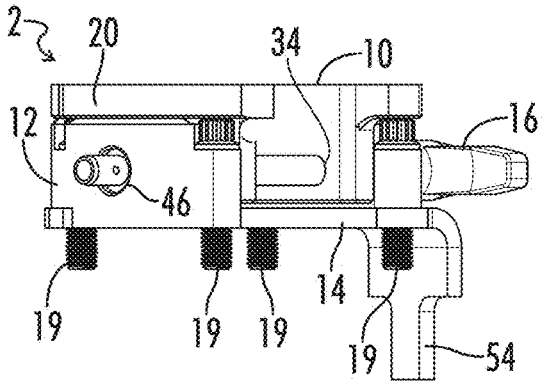
FIG. 8 is a side elevational view of the objects of FIG. 6.
Figure 9:
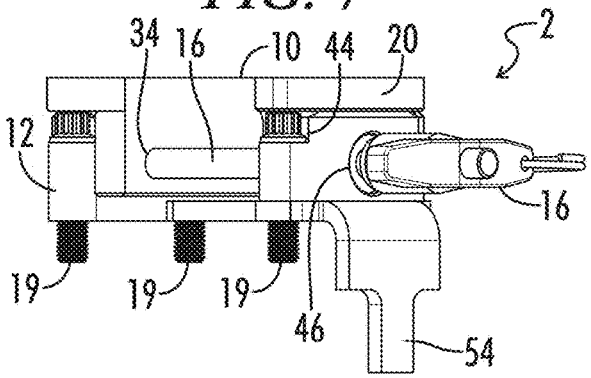
FIG. 9 is another side elevational view of the objects of FIG. 6 showing the objects rotated approximately 90 degrees clockwise.
Figure 10:
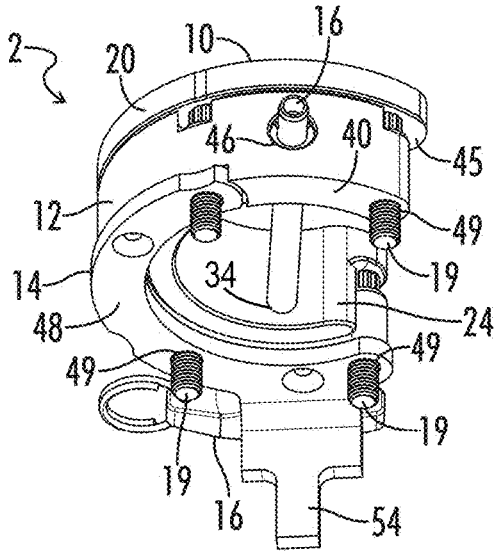
FIG. 10 is a depressed perspective view of the forward end of the objects of FIG. 6.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position. The upright firing position of a rotary machine gun or other multi-barrel weapon system is a generally level firing position. As used herein, the terms "aft" and "rear" means in a direction toward a rear end of a weapon, while the terms "front" and "forward" means in a direction extending away from the rear of the weapon toward the muzzles of the weapon. In some cases, the term "forward" can also mean forward beyond the muzzles of the weapon. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Turning now to FIGS. 6-27, there are shown multiple views of an embodiment of a spade grip attachment assembly 2 for securing a spade grip 50 to a minigun clutch 52 and rotor housing 102. As best shown in FIGS. 6-14, the attachment assembly 2 defines an axis 25 and includes a spade-side adapter member 10, a clutch-side adapter member 12, a locating member 14, a locking pin 16, and clutch bolts 19. As explained in more detail below, the spade-side adapter member 10 is configured to be secured to a spade grip 50 with preexisting bolts 126 native to the spade grip 50 (see FIGS. 15 and 17-20), while the clutch-side adapter member 12 is configured to be secured to a minigun clutch 52 (see FIGS. 16 and 21-24) with the clutch bolts 19. The clutch-side adapter member 12 is configured to receive the spade-side adapter member 10, and the spade-side adapter member 10 is configured to matingly engage the clutch-side adapter member 12 when the spade-side adapter member 10 is received in the clutch-side adapter member 12. The spade-side adapter member 10 and the clutch-side adapter member 12 are further configured to be secured to each other with the locking pin 16 when they are so matingly engaged. The locking pin 16 is receivable through each of the spade-side adapter member 10 and the clutch-side adapter member 12 to releasably lock the adapter members 10, 12 together when they are matingly engaged. In this way, a spade grip 50 to which is bolted a spade-side adapter member 10 of the invention can be quickly, easily, and releasably mounted to a minigun clutch 52 and rotor housing 102 to which is bolted a clutch-side adapter member 12 of the invention by securing the spade-side adapter member 10 in the clutch-side adapter member 12 with the locking pin 16.

The spade-side adapter member 10 includes a flange 20 and a protruding collar insert in the form of a short, hollow shaft or spud 24. Although the protruding collar insert is depicted in the presently disclosed embodiment as a spud 24, it is to be understood that in other embodiments, the protruding collar insert can have a different form or shape, such as, for example, a tapered neck or a non-circular shape. The spud 24 defines an exterior circumferential surface 18, the axis 25, a proximal end 26, and a free distal end 28. The spud 24 has an outer diameter 30 and a length 32 extending from the proximal end 26 to the free distal 28. The flange 20 extends away from the proximal end 26 of the spud 24. The flange 20 extends radially outward from the spud 24 at a normal angle to the axis 25. The flange 20 has a substantially uniform thickness 21 and includes four threaded bolt holes 22 defined therethrough. The threaded bolt holes 22 are arranged to align with four preexisting bolt holes 125 native to a preselected spade grip 50 (see FIG. 15) which is desired to be secured to a minigun clutch 52. The arrangement of bolt holes 125 in the spade grip 50 is a pattern standard to currently available minigun designs. This allows the preexisting bolts 126 native to the spade grip 50 to be used to secure the spade-side adapter member 10 to the spade grip 50, as exemplified in FIGS. 17-20.

Specifically, the spade-side adapter member 10 can be secured to the spade grip 50 by inserting the threaded portions of the bolts 126 forwardly through the preexisting bolt holes 125 on the spade grip and threading them into the aligned threaded bolt holes 22 of the flange 20 until tight. The thickness 21 of the flange 20 can be selected to be equal to or greater than the length of the threaded portion of the bolts 126 that protrudes forwardly from the spade grip 50. This ensures that the bolts 126 do not protrude forwardly beyond the flange 20 and interfere with the rest of the assembly 2.

Figure 11:
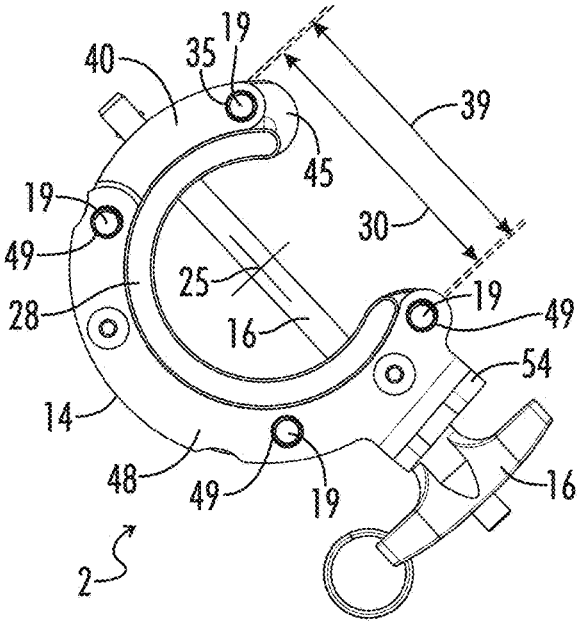
FIG. 11 is a plan view of the forward end of the objects of FIG. 6.
Figure 14:
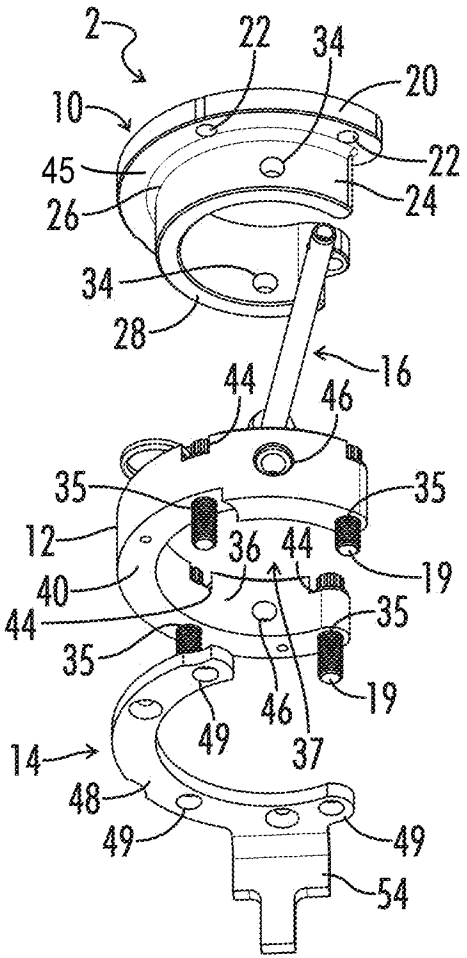
FIG. 14 is a partially exploded view of the objects of FIG. 10.
Figure 13:
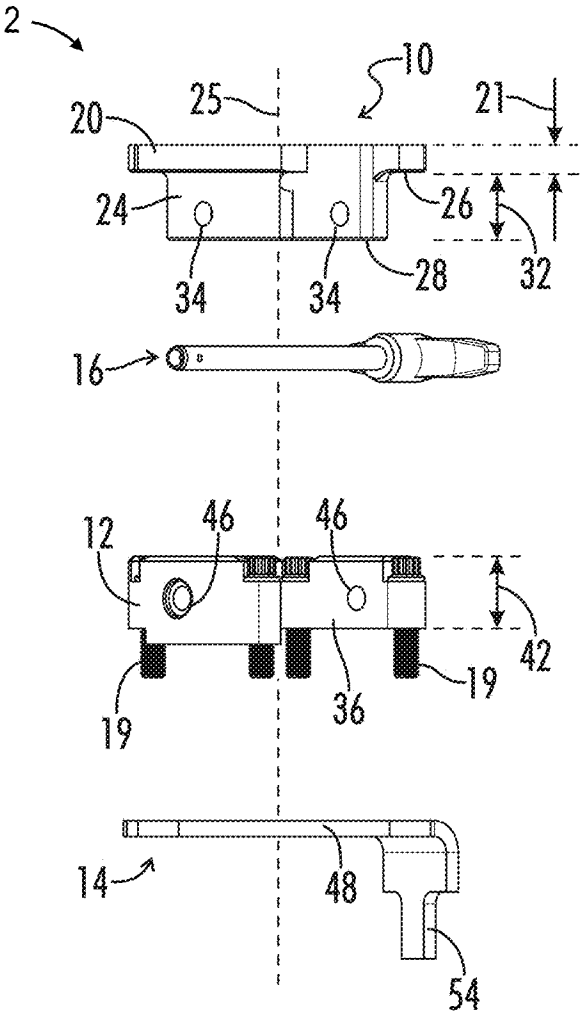
FIG. 13 is a partially exploded view of the objects of FIG. 8.
Figure 12:
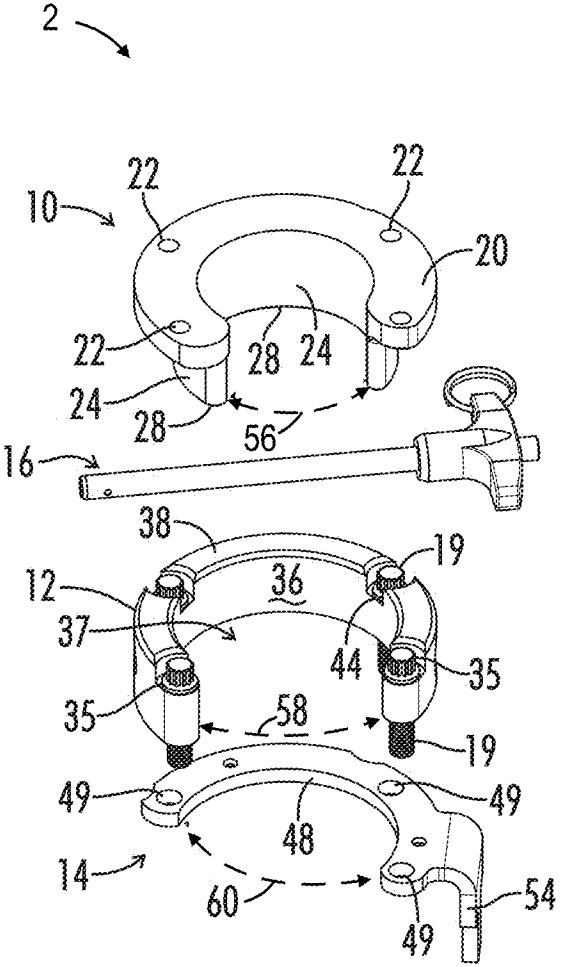
FIG. 12 is a partially exploded view of the objects of FIG. 6.
Figure 15:
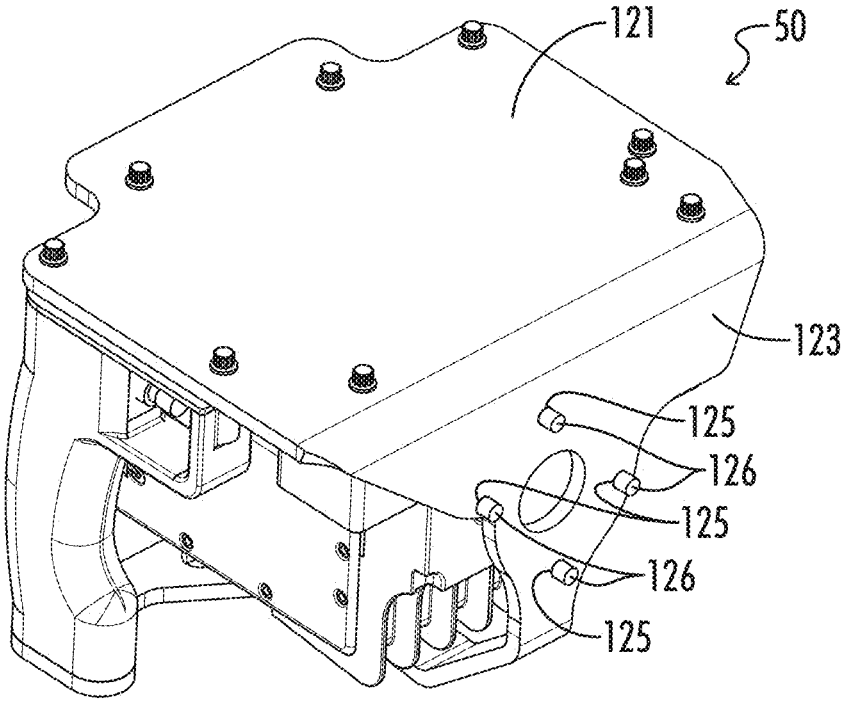
FIG. 15 is an elevated front right side perspective view of an assembled minigun spade grip ready for attachment to a minigun.
Figure 16:
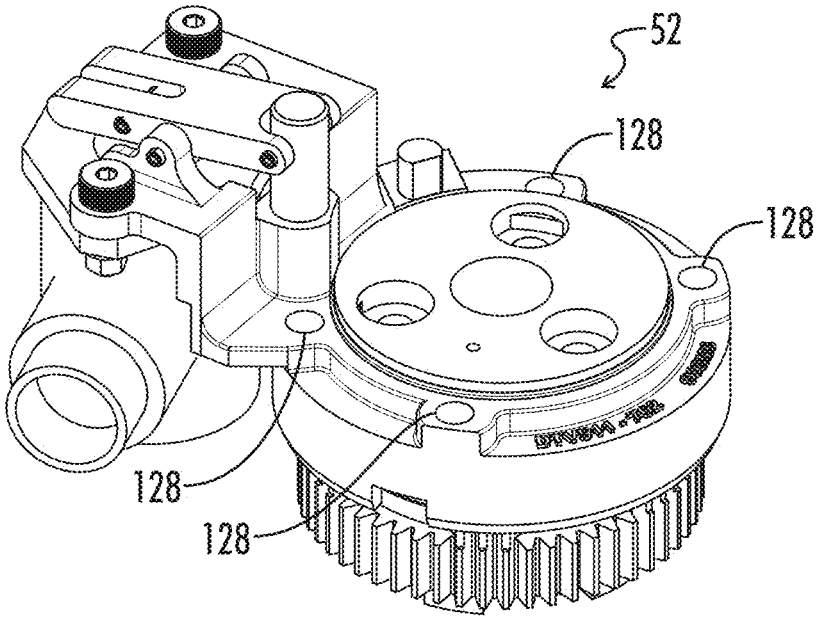
FIG. 16 is an elevated perspective view of the rear of a minigun clutch to which the spade grip of FIG. 15 is directly attachable.
Figure 17:
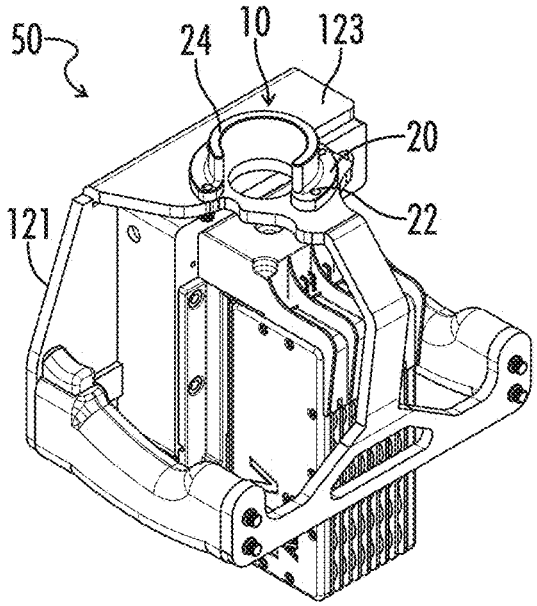
FIG. 17 is a depressed front right side perspective view of an assembled minigun spade grip with the spade-side adapter member component of the attachment assembly of FIG. 6 secured thereto.
Figure 18:
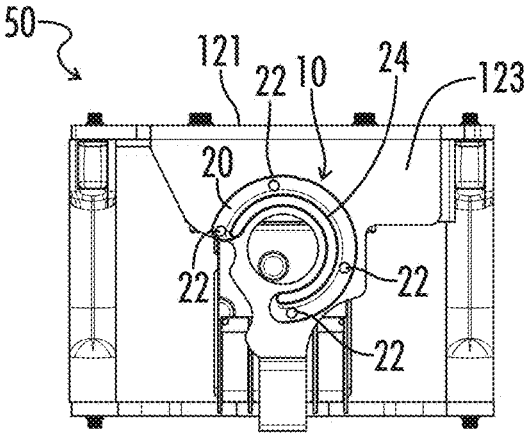
FIG. 18 is a front elevational view of the objects of FIG. 17.
Figure 19:
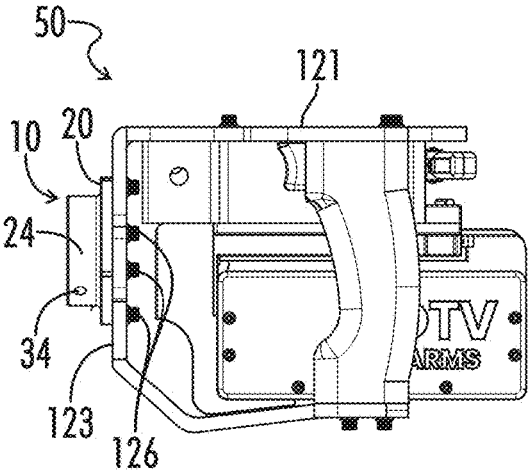
FIG. 19 is left side elevational view of the objects of FIG. 17.
Figure 20:
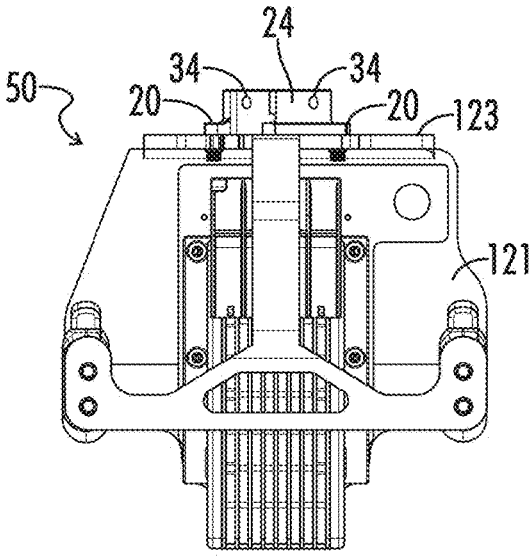
FIG. 20 is a bottom plan view of the objects of FIG. 17.
Figure 21:
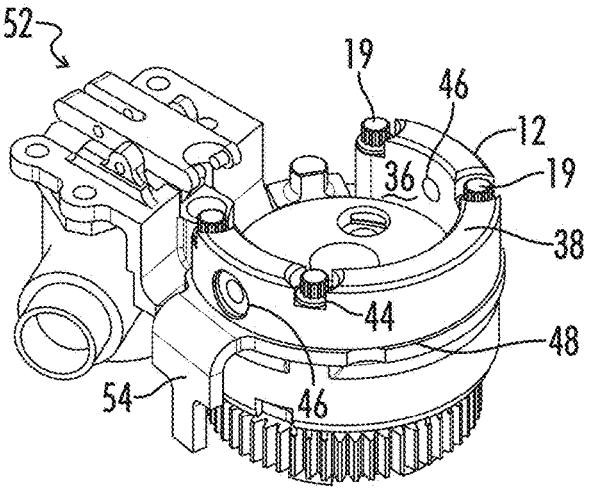
FIG. 21 is an elevated perspective view of the rear of a minigun clutch with the locating member and the clutch-side adapter member components of the attachment assembly of FIG. 6 secured thereto.
Figure 22:
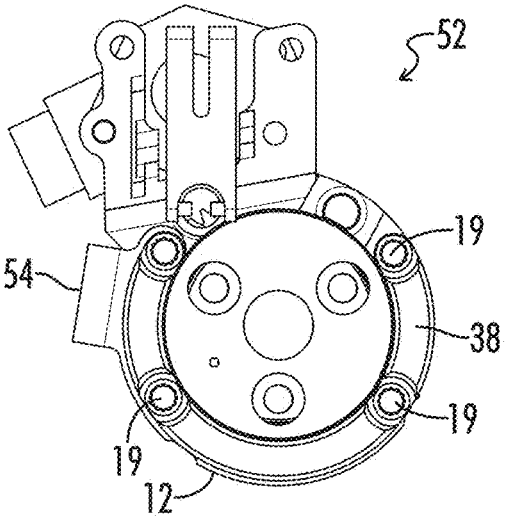
FIG. 22 is a plan view of the objects of FIG. 21.
Figure 23:
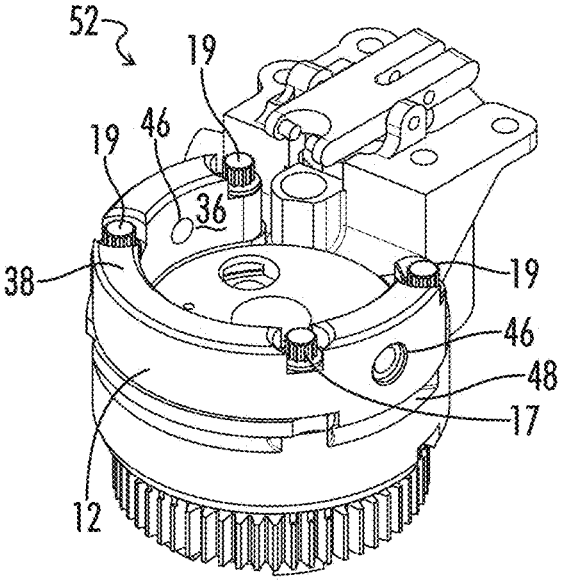
FIG. 23 another elevated perspective view of the objects of FIG. 21 with the objects rotated approximately 90 degrees clockwise.
Figure 24:
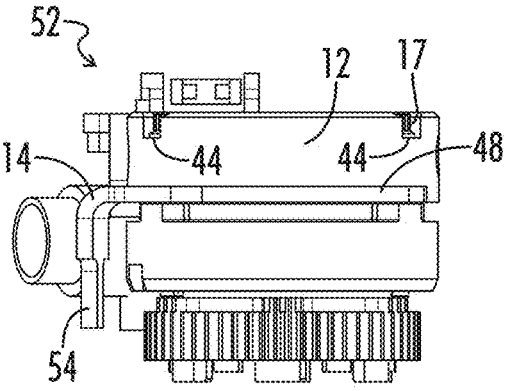
FIG. 24 is a side elevational view of the objects of FIG. 21.
Figure 25:
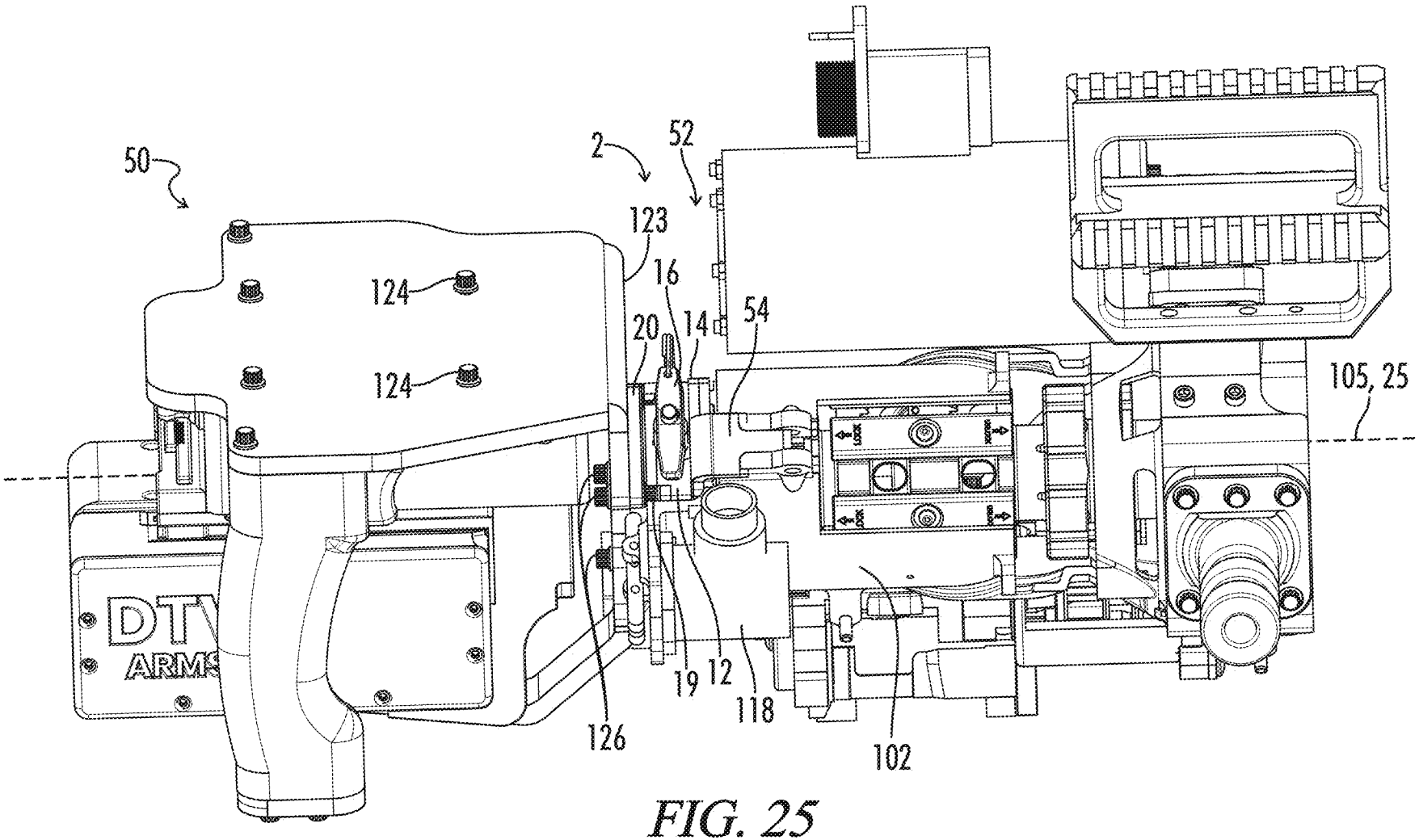
FIG. 25 is an elevated right side perspective view of a partially assembled minigun showing the spade grip of FIG. 17 secured to the minigun clutch of FIG. 21 by the spade grip attachment assembly of FIG. 6. Various minigun components, including the barrels, are omitted for clarity.
Figure 26:
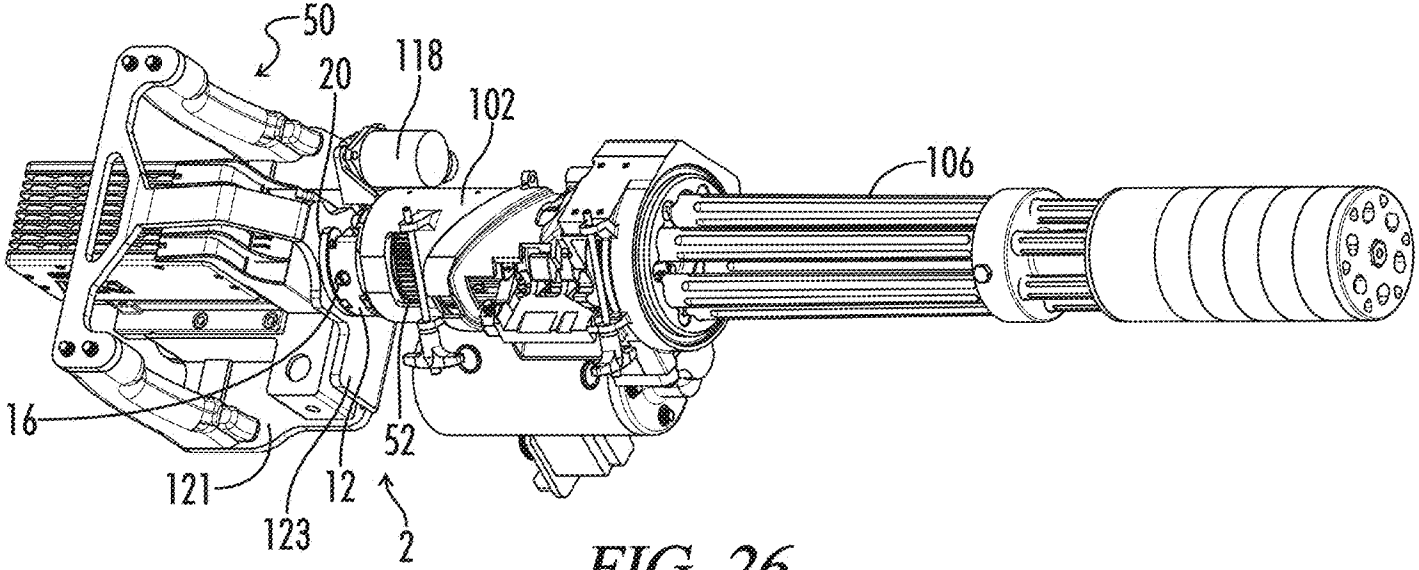
FIG. 26 is a perspective view of the bottom left side of the minigun of FIG. 25 showing the spade grip of FIG. 17 secured to the minigun clutch of FIG. 21 by the spade grip attachment assembly of FIG. 6. Various minigun components are omitted for clarity.
Figure 27:
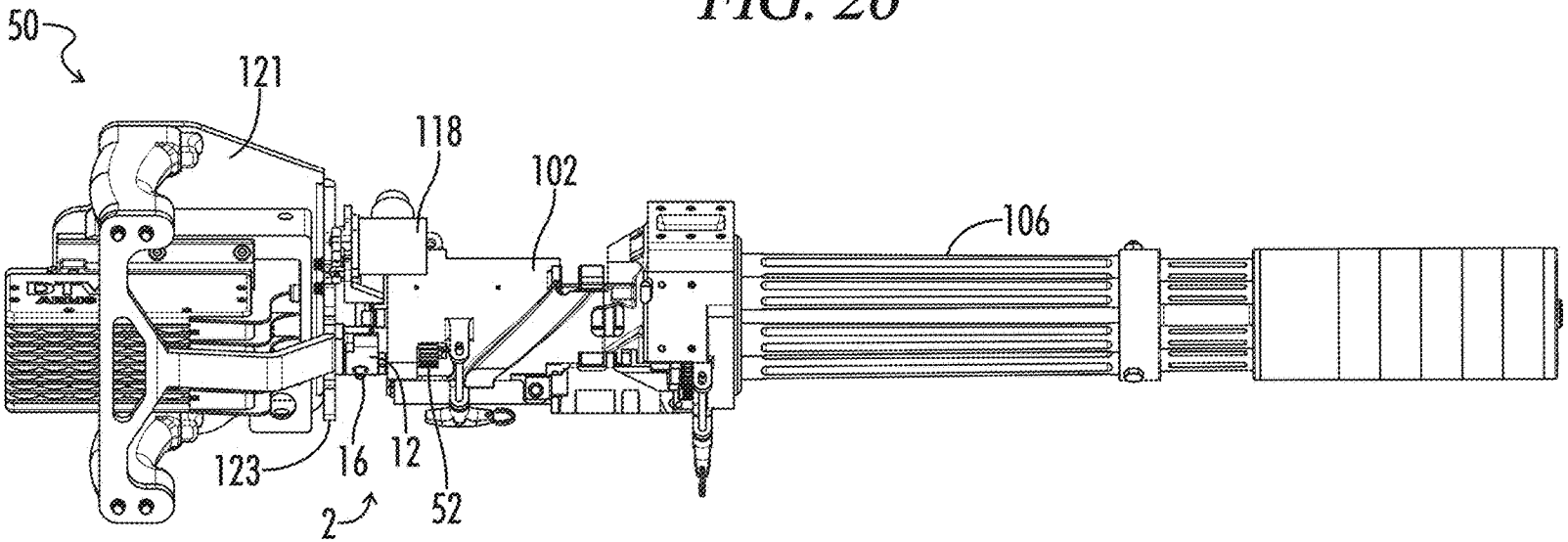
FIG. 27 is a bottom right side perspective view of the objects of FIG. 26.

The spud 24 further includes a pair of spaced apart pinholes 34 defined therein. The pin holes 34 are arranged such that the locking pin 16 is receivable through both pin holes 34 at once. In the depicted embodiment, the pinholes 34 are coaxially aligned and defined through opposing sides (i.e., sidewalls) of the spud 24 along the diameter 30 (i.e., opposite each other from the axis 25, as best shown in FIG. 11). However, it is to be understood that the pin holes 34 can alternatively be arranged so that they are not colinear with the diameter 30 of the spud 24. For example, the pinholes 34 can be spaced from the diameter 30 so as to define a chord of the spud 24 when viewed from the proximal 26 or distal 28 ends.

Referring again to FIGS. 6-14, the clutch-side adapter member 12 includes a collar 12. The collar 12 defines a rear surface 38, a forward surface 40, a thickness 42 extending from the rear surface 38 to the forward surface 42, and an interior surface 36. The collar 12 includes four bolt holes 35 defined therethrough. The bolt holes extend through the collar 12 parallel to the axis 25 from the rear surface 38 to the forward surface 40. The bolt holes 35 are arranged about the collar 12 to align with four preexisting threaded sockets 128 native to the preselected minigun clutch 52 (see FIG. 16) to which the spade grip 50 is desired to be secured. The arrangement of threaded sockets 128 in the minigun clutch 52 is a pattern standard to currently available minigun designs. The collar 12 can be secured to the clutch 52 with clutch bolts 19, as exemplified in FIGS. 21-24. Specifically, the collar 12 can be secured to the clutch 52 by inserting the threaded portions of the clutch bolts 19 into bolt holes 35 from the rear surface 38 and threading them into the aligned threaded sockets 128 of the clutch 52 until tight. The collar 12 also includes four slots or depressions 44 defined in the rear surface 38. Each slot or depression 44 is formed around a respect bolt hole 35 and is sized and shaped to receive a head 17 of a clutch bolt 19 such that each bolt head 17 is recessed from the rear surface 38 when the collar 12 is secured to the clutch 52 with the clutch bolts 19.

The collar 12 is configured to receive a portion of the spade-side adapter member 10. Specifically, the interior surface 36 of the collar 12 defines a space 37 in which the free distal end 28 of the spud 24 is slidably receivable. To ensure a snug fit and eliminate wobble or "slop" from the connection, the outer diameter 30 of the spud 24 is approximately the same diameter as, but not greater than, an inner diameter 39 of the collar 12. The inner diameter 39 of the collar 12 (and thus the diameter of the space 37) is defined by the interior surface 36. In this way, the spud 24 and space 37 are respectively dimensioned so that the exterior surface 18 of the spud 24 engages the interior surface 36 of the collar 12 when the spud 24 is received in the collar 12. At the same time, a forward surface 45 of the flange 20 can engage the rear surface 38 of the collar 12. In addition, the length 32 of the spud 24 can be approximately the same as, but preferably not greater than, the thickness 42 of the collar 12. This strengthens and stiffens the connection between spade-side adapter member 12 and the clutch-side adapter member 12, while at the same time prevents the spud 24 from interfering with operation of the clutch 52.

The collar 12 further includes a pair of spaced apart pinholes 46. The pin holes 46 are arranged such that the locking pin 16 is receivable in both pin holes 46 at once. In the depicted embodiment, the pinholes 46 are coaxially aligned and defined through opposing sides (i.e., sidewalls) of the collar 12 along the diameter 39 (i.e., opposite each other from the axis 25). However, it is to be understood that the pin holes 46 can alternatively be arranged so that they are not colinear with the diameter 39 of the collar 12. For example, the pinholes 46 can be spaced from the diameter 39 so as to define a chord of the collar 12 when viewed from the front or rear. The pair of pin holes 46 in the collar 12 are arranged to align with the pair of pin holes 34 in the spud 24 to form a passage 47 through which the locking pin 16 can be inserted to secure the spade-side adapter member 10 to clutch-side adapter member 12 when the spud 24 is received in the collar 12.

Referring yet again to FIGS. 6-14, the locating member 14 includes a main body 48 with three bolt holes 49 defined therethrough, and a locating tab 54 extending from the main body 48 parallel to the axis 25 at a normal angle to the main body 48. The locating tab 54 is alike in all aspects of form and function to the locating tab 134 of conventional annular locating members 132 of the prior art, except as specifically described herein. The bolt holes 49 are arranged about the main body 48 to align with three of the four bolt holes 35 in the collar 12 and three of the four preexisting threaded sockets 128 of the minigun clutch 52 (see FIG. 16). The locating member 14 is secured to the clutch 52 between the clutch 52 and the collar 12 by bolts 19. For example, the locating member 14 can be secured to the clutch 52 by placing the main body 48 on the rear end of the clutch 52, aligning the bolt holes 49 with the respective threaded sockets 128, stacking the collar 12 on the main body 28 with the bolt holes 35 aligned with the respective bolt holes 49 of the main body 48, inserting bolts 19 through bolt holes 35 and 49, and threading the bolts 19 into the sockets 128 until tight.

In the embodiment of the invention depicted in the figures, the spade-side adapter member 10, the clutch-side adapter 12, and locator member 14 are each generally C-shaped (i.e., have a generally C-shaped profile) such that each member defines a gap in the body thereof. For example, the spade-side adapter member 10 defines a spade adapter gap 56, the clutch-side adapter member 10 defines a clutch adapter gap 58, and the locating member 14 can be an incomplete ring that defines a tab gap 60. The resulting C-shape enables the body of each member of the attachment assembly 2 to host all the necessary bolt holes with sufficient strength and durability to withstand the awesome force and heat generated by sustained minigun fire, while also minimizing the weight of the full assembly 2.

Additionally, the gaps 56, 58, 60 of the three assembly members 10, 12, 14, respectively, are arranged to align with each other and face the same direction when the assembly members 10, 12, 14 are properly aligned with the spade grip 50 and clutch 52 and rotor housing 102. This reduces the overall weight of the attachment assembly 2. It also aids in installation, repair, and (re)assembly of the attachment assembly 2, especially in low light environments or under high stress conditions. However, other shapes, including but not limited to circular (i.e., annular), square, etc., can also be used to form each member 10, 12, 14 of the attachment assembly 2 without departing from the scope of the invention, so long as one of the spade-side adapter member 10 or the clutch-side adapter member 12 is receivable in the other, and the two adapter members 10, 12 are configured to align such that the locking pin 16 is receivable through both members 10, 12, as discussed above.

The attachment assembly 2 described herein may be used in the following manner to connect a spade grip 50 to any legacy minigun having a clutch 52 or rotor housing 102. The spade-side adapter member 10 is secured to the front side 123 of the spade grip 50 using the four preexisting bolts 126 native to the spade grip 50 as described above. Once secured to the front end 123 of the spade grip 50, the spade-side adapter member 10 can be permanently left in place. Similarly, the locating member 14 and then the clutch-side adapter member 12 may be stacked onto the rear end of the clutch 52 and secured to the clutch 52 using the clutch bolts 19 as described above. As with the spade-side adapter 10, the clutch-side adapter member 12 and locating member 14 may be permanently left in place on the clutch 52. Once the spade-side adapter member 10 is secured to the spade grip 50 and the clutch-side adapter member 12 and locating member 14 are secured to the minigun clutch 52 or rotor housing 102, the male portion of the spade-side adapter member (i.e., the spud 24) can be slid into mating engagement with the female portion of the clutch side adapter member (i.e., the space 37 defined by the collar 12). The spade grip 50 may be rotated about axis 25 to align the pinholes 34 of the spade-side adapter member 10 with the pinholes 46 of the clutch side adapter member 12. Once the pinholes 34, 46 are aligned, the locking pin 16 is inserted through the passage 47 formed by the aligned pin holes 34, 46 to secure the adapter members 10, 12 (and thus the respectively attached spade grip 50 and minigun clutch 52) together. To separate spade grip 50 from the minigun clutch 52, the locking pin 16 need only be withdrawn from the pin holes 34, 46, and the adapter member 10, 12 decoupled by pulling the spade-side adapter member 10 out of the clutch-side adapter member 12.

The advantages of the presently disclosed attachment assembly 2 are numerous. For example, when manufactured from 17-4 stainless steel, an attachment assembly 2 such as that shown in the figures can weigh as little as 15.5 ounces and increase the length of the fully assembled minigun by no more than 0.5 inches. Because weight constraints are particularly critical when a minigun is mounted in an aircraft, the minimal increase in weight allows the aircraft to continue operating at a greater range and/or for longer periods of time. Additionally, the attachment assembly 2 provides the same feel and lockup expected from the legacy spade grip design. Furthermore, an operator may now more easily remove a spade grip 50 from a minigun equipped with an attachment assembly 2 disclosed herein for maintenance, repair, transportation, or replacement simply by manually pulling the locking pin 16 out of the assembly 2 to release the spade grip 50 from the minigun clutch 52. The resulting lack of need for tools to remove the spade grip 50 may eliminate the need to transport tools with the minigun during operation, which can provide additional weight savings.

Likewise, for transportation, the operator may remove the locking pin 16 the assembly 2 as described above, unplug the clutch and motor wires, and remove the spade grip 50 from the minigun. The spade grip can then be stored securely in a smaller transportation box, or with the minigun in its transportation box. As the spade grip 50 typically extends the length of the minigun by about 8 inches, its simple removal allows the transportation box to be smaller and lighter. Once the minigun arrives at its desired location, it can be removed from its transportation box, mounted in position, and the spade grip can then quickly reattached and ready for operation in seconds.

Furthermore, the spade grip attachment assembly 2 disclosed herein allows the operator to change the minigun between AC power, DC power and wireless power quickly. Specifically, individual spade grips and their corresponding GCUs are designed to run on AC power, DC power, or wireless power. To switch between these power modes, the operator need only remove the locking pin 16 from an assembled minigun equipped with the disclosed attachment assembly 2 as described above, remove the spade grip of one power mode, and reattach a different spade grip of another power mode with a spade-side adapter member 10 secured thereto. This saves time and money by using the same registered minigun rather than requiring the use of multiple miniguns with different types of spade grips and GCUs.

Although embodiments of the present invention have been described in detail, it will be understood by those skilled in the art that various modifications can be made therein without departing from the spirit and scope of the invention as set forth in the appended claims. For example, although the spade-side adapter member 10 is depicted as being the "male" member with a protruding collar insert in the form of spud 24 and the clutch-side adapter member 12 is depicted as being the "female" member with a space 37 in which the spud 24 is receivable, it should be understood that this arrangement can be reversed in alternative embodiments such that the clutch-side adapter member includes a protruding collar insert and the spade-side adapter member defines a space in which the protruding collar insert of the clutch-side adapter member is receivable. All such versions are contemplated by the present invention.

Additionally, although the attachment assembly 2 disclosed herein can be formed of 17-4 stainless steel alloy as described above, it may alternatively be formed from one or more other durable metals or metal allows, including but not limited to aluminum and titanium. Also, although the attachment assembly 2 disclosed herein is described for use with a legacy minigun and spade grip, it is contemplated that newly manufactured miniguns may be formed with appropriate members of the attachment assembly 2 integrally formed therewith. For example, a minigun clutch can be manufactured with a clutch-side adapter member 12 integrated onto the rear face thereof. Also, a spade grip can be manufactured with a spade-side adapter member 10 integrated onto the forward surface thereof.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An attachment assembly for securing a spade grip to a minigun, the assembly comprising:

a first adapter member on the spade grip; and a second adapter member on the minigun;

wherein said adapter members are configured to be releasably secured to each other.

2. The assembly of claim 1, wherein one of said adapter members is slidably receivable in and releasably securable with the other of said adapter members.

3. The assembly of claim 1, wherein said adapter members are configured to be releasably secured to each other with a fastener.

4. A minigun, comprising:

the assembly of claim 3;

wherein the first adapter member is secured to the second adapter member with the fastener.

5. The assembly of claim 1, wherein:

the first adapter member forms an incomplete ring and defines a first adapter gap;

the second adapter member forms an incomplete ring and defines a second adapter gap; and the first adapter gap aligns with and faces the same direction as the second adapter gap when the first adapter member is secured to the second adapter member.

6. A method of attaching a spade grip to a minigun, comprising:

providing the assembly of claim 1; and securing the first adapter member to the second adapter member.

7. A minigun, comprising:

the assembly of claim 1;

wherein the first adapter member is secured to the second adapter member to secure the spade grip to the minigun.

8. An attachment assembly for securing a spade grip to a minigun, the assembly comprising:

a first adapter member configured to be secured to the spade grip; and a second adapter member configured to be secured to the minigun;

wherein said adapter members are configured to be releasably secured to each other.

9. The assembly of claim 8, wherein one of said adapter members is slidably receivable in and releasably securable with the other of said adapter members.

10. The assembly of claim 8, wherein said adapter members are configured to be releasably secured to each other with a fastener.

11. The assembly of claim 8, wherein:

the first adapter member forms an incomplete ring and defines a first adapter gap;

the second adapter member forms an incomplete ring and defines a second adapter gap; and the first adapter gap aligns with and faces the same direction as the second adapter gap when the first adapter member is secured to the second adapter member.

12. A method of attaching a spade grip to a minigun, comprising:

providing the assembly of claim 8;

securing the first adapter member to the spade grip;

securing the second adapter member to the minigun; and securing the first adapter member to the second adapter member.

13. A minigun, comprising:

the assembly of claim 8;

wherein the first adapter member is secured to the second adapter member to secure the spade grip to the minigun.

14. A minigun, comprising a spade grip secured to the minigun housing with the assembly of claim 8.

15. An attachment assembly for securing a spade grip to a minigun, the assembly comprising:

a first adapter member on the spade grip; and a second adapter member on the minigun;

wherein the first adapter member and the second adapter member are configured to be releasably secured to each other with a fastener.

16. The assembly of claim 15, wherein one of the first adapter member and the second adapter member is receivable in the other of said adapter members.

17. The method of claim 15, wherein the fastener is a locking pin.

18. The assembly of claim 15, wherein:

the first adapter member forms an incomplete ring and defines a first adapter gap;

the second adapter member forms an incomplete ring and defines a second adapter gap; and the first adapter gap aligns with and faces the same direction as the second adapter gap when the first adapter member is secured to the second adapter member.

19. A method of attaching a spade grip to a minigun housing, comprising:

providing the assembly of claim 15; and securing the first adapter member to the second adapter member with the fastener.

* * * * *